United States Patent [19]

Jaeger

[11] Patent Number: 4,720,067

[45] Date of Patent: Jan. 19, 1988

[54] METHOD FOR INCREASING THE NUMBER OF SIGNALS WHICH MAY BE TRANSMITTED FROM A GROUND STATION TO A RAIL VEHICLE

[76] Inventor: Walter Jaeger, Bel Bosco, CH-6951 Cureglia, Switzerland

[21] Appl. No.: 680,260

[22] PCT Filed: Mar. 12, 1984

[86] PCT No.: PCT/CH84/00038

§ 371 Date: Nov. 9, 1984

§ 102(e) Date: Nov. 9, 1984

[87] PCT Pub. No.: WO84/03672

PCT Pub. Date: Sep. 27, 1984

[30] Foreign Application Priority Data

Mar. 14, 1983 [CH] Switzerland ..... 1381/83
Mar. 14, 1983 [CH] Switzerland ..... 1380/83

[51] Int. Cl.[4] ..... B61L 3/20

[52] U.S. Cl. ..... 246/34 B; 246/63 R; 246/167 R

[58] Field of Search ..... 370/11; 246/167 R, 182 R, 246/187 R, 34 R, 34 B, 34 A, 63 R, 63 C, 63 A; 340/825.52; 323/235; 455/142

[56] References Cited

U.S. PATENT DOCUMENTS 2,498,675 2/1950 Grieg ..... 455/142
3,453,597 7/1969 Pomerenc ..... 340/825.52
3,959,586 5/1976 Blomenkamp .
4,257,032 3/1981 Schneider ..... 246/167 R
4,487,385 12/1984 Salmon ..... 246/167 R
4,521,892 6/1985 Vance ..... 370/11
4,604,517 8/1986 Barry ..... 323/235

FOREIGN PATENT DOCUMENTS 2623073 5/1976 Fed. Rep. of Germany ..... 370/11
1237468 10/1977 Fed. Rep. of Germany .
2302653 9/1976 France .
2337385 7/1977 France .

OTHER PUBLICATIONS

"Cab Signalling on the New Tokaidoline", The Railway Gazette, vol. v56-123, No. 18, Sep. 1967, London (GB), pp. 701-704.

Goldberg and Bath, "Multiplex Employing Pulse-Time and Pulse-Frequency Modulation", Proceedings of the Institute of Radio Engineers, vol. 37, No. 1, Jan. 1949.

*Primary Examiner*—John W. Caldwell, Sr.
*Assistant Examiner*—Alvin Oberley
*Attorney, Agent, or Firm*—Phillips, Moore, Lempio & Finley

[57] ABSTRACT

To increase the number of different signals which may be transmitted from a ground station provided with a coder (17) to a rail vehicle (1) provided with a decoder (18) and being on a rail section connected to the station, the transmission is carried out by inductance by means of electric alternating current with both pulse-frequency modulation and pulse-width modulation.

8 Claims, 5 Drawing Figures

METHOD FOR INCREASING THE NUMBER OF SIGNALS WHICH MAY BE TRANSMITTED FROM A GROUND STATION TO A RAIL VEHICLE

The present invention relates to a method of increasing the number of differentiated signals that can be sent from a base station equipped with a coder to a rail vehicle, fitted with a decoder, that is located on a section of track connected to the said base station, and to a method for transmitting signals from at least two base stations, each provided with a coder, to two different railroad vehicles located on two different sections of track that are connected each to one of said base stations, said rail vehicles being provided each with a decoder and being capable of moving on both sections of track, the signals being sent separately from each other and being intermingled at least in part both with regard to time.

It is known that signals can be sent inductively from a base station to a locomotive located on a section of track by using pulse frequency modulation. To this end, the section of track is generally made up of two rails that are insulated from each other. These two rails are terminated at the start and the end of a block in each instance by a special transformer. In general, conventional systems transmit four different items of information by pulse frequency modulation at different levels. However, the introduction of high-speed railroad systems necessitates the transmission of more information than was formerly the case. For this reason, it has already been proposed that the number of installations be doubled, and that a second alternating current frequency be employed for the transmission of additional information. However, a system of this kind entails prohibitive costs.

It is a task of the present invention to provide a method that will permit an increase in the number of signals that can be transmitted from a base station to a railroad vehicle, using additional, simple means and, above all else, without any substantial modification of existing systems.

According to the present invention this task has been solved by a method of the kind described in the introduction hereto, in by effecting said transmission both by a pulse frequency modulated carrier and simultaneously by a pulse width modulated carrier.

In order to effect transmission by technical means available today it is advantageous if an electrical alternating current is used as a carrier, transmission being effected inductively.

If the signals are transmitted by alternating current pulses of different durations, the pulses containing several half-waves and alternating with spaces between pulses of different lengths, then in order to provide for the simultaneous transmission of two sets of information the frequency of the pulse frequency modulation should be determined by the time width of the alternating current pulses and by the time width of the current pauses. The pulse width should be determined exclusively by the width of the alternating current pulse.

In order to ensure that no modifications to existing equipment are required and that existing coders can process the signal generated using existing methods, it is advantageous that the width of the alternating current pulse for pulse width modulation is within the existing range of the frequency modulated alternating current pulse.

In order to ensure reliable differentiation of the pulse lengths, it is advantageous if the time widths of the alternating current pulses and of the pauses correspond to integer, preferably even-number, multiples of the alternating current half-wave time.

In order to permit pulses that are sharply defined in relation to pulse length, at the pulse length provided by the present systems it is desirable that the current pulse switches on an alternating current source at the voltage zero-crossing point and switches this source off at the current zero-crossing point.

Particularly reliable switching is provided when the zero axis is crossed if the alternating current source is switched electronically.

Furthermore, in order to provide for reliable acquisition of the pulses it is preferable that the decoding be carried out electronically.

It is also advantageous if, in order to avoid disruptions caused by random pulses, downstream of the decoder, only a sequence of a specific number of equal pulse signals cause a corresponding output signal.

Since current pulses of strictly defined duration are used, these pulses replacing conventional time-based pulse recognition by digital recognition, it is desirable that the decoder counts the half-waves of the current pulses that are switched on and off digitally.

In order that counting be independent of frequency fluctuations in the alternating current that forms the current pulses, it is advantageous that the counter system of the decoder be synchronised with the frequency of the alternating current source by means of a flywheel circuit.

In order to permit compatibility with existing equipment, the decoder used should reproduce all the signals lying in the range of the existing signal as one and the same signal Furthermore it is known, that signals can be transmitted inductively from a base station to a railroad vehicle. High-speed rail systems that are being introduced demand more and different signals. However, at least exceptionally locomotives of existing and new kinds must be able to travel on new and existing rail systems. For operational reasons, conversion of existing systems is extremely costly and scarcely possible from the operational point of view.

It is another task of the present invention to provide a method that permits the above-discussed compatibility and permits the use of both existing track and signalling systems and also the existing equipment of the locomotives without the need for modification.

According to the present invention, this task has been solved by a method for transmitting signals from at least two base stations, each provided with a coder, to two different rail vehicles located on two different sections of track that are connected each to one of said base stations, said rail vehicles being provided each with a decoder and being capable of moving on both sections of track, the signals being sent separately from each other and being intermingled at least in part both with regard to time, which is characterized in that at least one auxiliary signal being transmitted from at least one base station to the associated section of rail, and at least one of the rail vehicles being provided with a decoder that produces a different interpretation of the input signals that are to be decoded if the auxiliary signal is present.

To a very great extent, systems that have been introduced, operate on the basis of pulse modulation of an alternating current. Thus, it is advantageous if the signal that is passed to one section of track is pulse frequency modulated, and if the signal passed to the other section of track together with the pulse code modulated auxiliary signal is pulse width modulated, and that the decoder of one rail vehicle operates with pulse frequency modulation whereas the other rail vehicle operates additionally with pulse width demodulation or pulse code demodulation, respectively.

The invention will now be described in more detail by way of example only, with reference to the accompanying drawings, in which.

Figure 1:
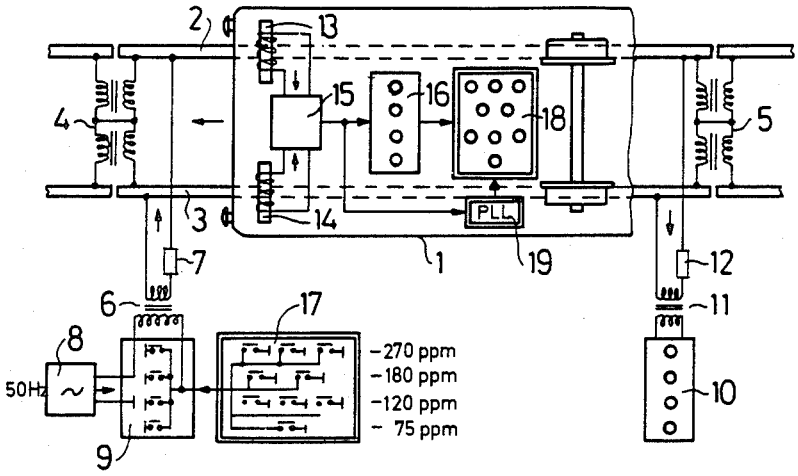
FIG. 1 is a schematic representation of one embodiment of an arrangement for implementing the method according to the first present invention.

As can be seen from FIG. 1, a locomotive 1 is located on a block formed from the rail sections 2 and 3, which are electrically insulated from each other. At both ends, the rail sections 2 and 3 are connected to each other, to the previous, and to the subsequent blocks through the transformers 4 and 5.

At one end, the blocks are supplied through signals with 50 Hz alternating current. This supply is effected through a feed transformer 6 and a resistance 7 connected in series. The power source 8 is applied in pulse mode to the transformer 6 through a pulse selection system 9 of the sort that was formerly normally mechanical. The time ratio of the current-carrying pulses J to the current pauses Q between these is, in practice, between 35 and 65%, as can be seen from FIG. 2.

At the other end of the block there is a conventional control system 10, connected to the rail sections 2 and 3 through a transformer 11 and a resistance 12 connected in series. The control system indicates not only whether or not there is a locomotive or other rolling stock in the section, but also which of the pulse series $J_1$, $Q_1$ to $J_4$, $Q_4$ is switched on.

On the locomotive 1 there are two inductive pickups 13, 14 arranged in the vicinity of the rails. A gating circuit 15 passes the cleaned frequency-modulated pulse trains received by the pickups 13 and 14 to the gating circuit 16.

Thus, the gating circuit 16 always indicates the pulse train sent from the pulse selection system 9.

Each of the elements described above are familiar and in practical use.

Figure 2:
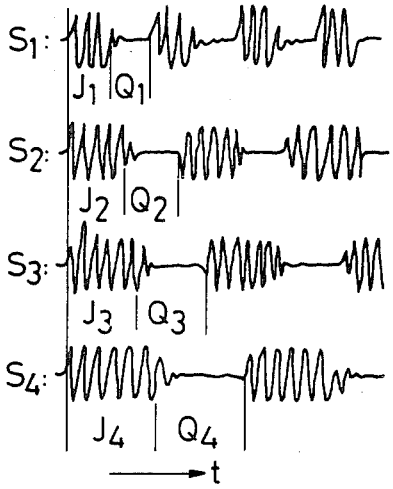
FIG. 2 shows the pulse train corresponding to the signals now used.

In order to transmit the additional signals that are required for high-performance express routes, an additional pulse-shaping system 17 that modulates the time width of the current pulses is incorporated between the AC power source 8 and the transformer 6. This additional pulse-shaping system 17 generates pulses of extremely precise duration, the pulse widths always being within the variation widths tlmin. and tlmax. of the signals $S_1$, $S_2$, $S_3$ and $S_4$ (FIGS. 2 and 3).

In order to generate these pulses, which are of precisely specified pulse width, the additional pulse-shaping system 17 is switched electronically. The pulse is switched on when the power source 8 crosses the voltage zero axis and switched off when the pulse current crosses the current zero axis.

Figure 3:
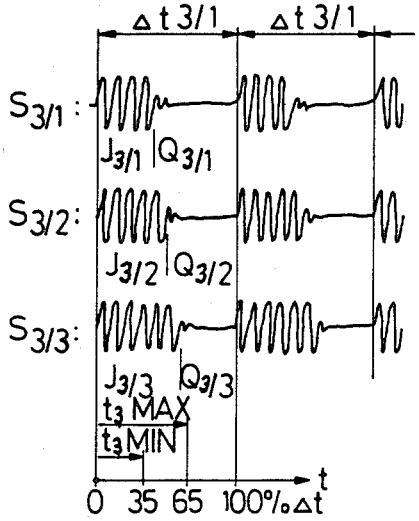
FIG. 3 shows three new pulse shapes used according to a first method according to the present invention in place of a single signal now used.

In a practical railroad system loading results only in a small non-disruptive final oscillation Ns as can be seen in FIG. 3 after switching off.

Since the duration of the new pulses lies within the variation range tlmin. to tlmax., of the formerly used pulses, an existing gating circuit 16 functions unchanged with the new signals (FIG. 3) vis-a-vis a use of the former signals.

However, it is also possible to use, in addition, a gating circuit 18 the discriminates the pulse widths, and can thus interpret the new pulses $J_{1/1}$, $Q_{1/1}$, $Q_{1/2}$ and $J_{1/3}$, $Q_{1/3}$ separately from each other and form the corresponding signals $S_{1/1}$, $S_{1/2}$, and $S_{1/3}$.

Since the frequency of the alternating current source 8 can vary slightly for the different blocks, the additional gating circuit 18 is continuously synchronized with the mean value of the alternating current power source 8 associated with the section, this being done by means of the flywheel circuit 19.

In order that casual pulse disruptions do not result in false signals, the gating circuit 18 is so designed that an output signal is only generated only after repeated submission of one and the same signal in several sequential time segments $\Delta t1$, $\Delta t2 \ldots \Delta tn$.

The second method according to the present invention will be described in greater detail below.

Figure 5:
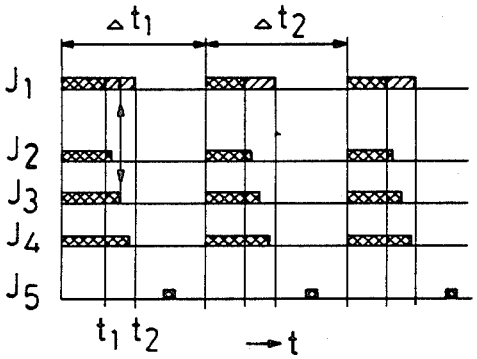
FIG. 5 is a schematic representation of the signals used in the second method according to the present invention when pulse modulation is used.

FIG. 5 shows two rail sections 20, 21, the former being used for a conventional railroad track, and the latter for a high-speed track.

The rail section 20 is connected for the transmission of the signals $S_1$ through said rail section to a base station 23 that is linked to a coder 22.

Analogously, the high-speed rail section 21 is connected for the transmission of signals $S_2$, $S_3$, $S_4$ through said track to a base station 25 that is linked to a coder 24. The base station 25 also passes an auxiliary signal $S_5$ to the rail section 21.

To the left on the rail section 20 and on rail section 21 there is in each instance a high-speed railroad train 26 equipped with a decoder 27 that is controlled by means of an auxiliary signal $S_5$, whilst to the right there is in each instance a train 28 equipped with a non-switchable decoder 29.

Figure 4:
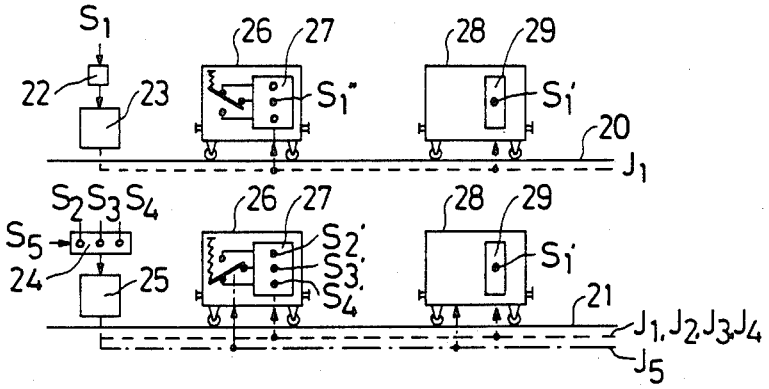
FIG. 4 is a schematic representation of a second method according to the present invention.

FIG. 5 shows the electrical pulses that correspond to the signals $S_1$ to $S_5$ used in FIG. 4, said electrical pulses being used during pulse frequency modulation to transmit $S_1$ and during pulse width modulation to transmit $S_2$, $S_3$ and $S_4$.

The signal $S_1$, as used on previous sections of rail, generates a current pulse $J_1$, the length of which can be between $t_1$ and $t_2$.

The signals $S_2$, $S_3$ and $S_4$ as they can be used on high-speed sections, generate current pulses $J_2$, $J_3$ and $J_4$, the lengths of which can also lie between $t_1$ and $t_2$.

Thus, in the version based on FIGS. 4 and 5, it is possible that, for example, a pulse $J_1$ can be of the same duration as a pulse $J_3$ and for this reason may, if pulse width modulation is used, be indistinguishable from $J_1$.

A high-speed locomotive 26 on a conventional section 20 could generate disastrous false information on the latter. For this reason, in order to avoid this, an auxiliary signal $S_5$ is transmitted on the high-speed section 21 in addition to the signals $S_2$, $S_3$ and $S_4$ that are to be transmitted.

This auxiliary signal means that the decoder 27 will only generate the signals $S_2'$, $S_3'$, and $S_4'$ is this signal is present, i.e. only on the high-speed sectin 21.

If this auxiliary signal is not present, as on the normal section 20, even if there is a signal $S_1$ that incidentally corresponds to a signal $S_2$, $S_3$, or $S_4$, a signal $S_1''$ that corresponds to a prescribed standardised value will be generated.

I claim:

1. A method for transmitting signals to first and second kinds of rail vehicles, and in which there is a base section equipped with a coder, the base section being connected to a section of track on which said first and second kinds of vehicles may run, each of the first knd of vehicle having a decoder that operates by pulse frequency demodulation only and is equally responsive to signals of a pulse frequency modulated carrier of a predetermined pulse frequency in which the pulse duration is of any value within a given range of percentage of the period of the frequency of the signals, characterized by:

(a) transmitting a plurality of different signals from said base section to said section of track by an alternating current carrier that is both frequency modulated and pulse width modulated, with the frequency of modulation of all of said different signals being the same as that to which the decoder of said first kind of rail vehicle is responsive and with the pulse width modulation being such that each signal has a pulse width which is one of a preselected number of different predetermined percentages of pulse width to the period of the frequency of the pulse, and in which each of said different predetermined percentages of pulse width to pulse period of the frequency of the pulse is within said given range of percentage the period of the pulse frequency to which said decoder of said first rail vehicle is responsive, and (b) equipping each of said second kind of rail vehicle with a decoder that operates on said signals by pulse frequency demodulation and is responsive to signals of the pulse frequency of said transmitted signals and that also operates on said signals by pulse width demodulation and is separately responsive to each of the preselected number of differently pulse width modulated signals that are transmitted.

2. A method as set forth in claim 1, further characterized by transmitting said signals as current pulses of varying duration each containing several half-waves of said carrier, in alternation with current pauses, that are also of varying lengths, the time widths of the current pulses and of the current pauses being integral and preferably even-number multiples of the alternating current carrier half-wave time, and electronically switching the current pulses on and off at zero-crossings of the alternating current carrier.

3. A method as set forth in claim 2, further characterized by electronically decoding said signals at a second rall vehicle and, after said signals are decoded, producing an output signal only after a sequence of equal pulse length signals have been decoded.

4. A method as set forth in claim 3, further characterized in that the decoding at said second rail vehicle is done by digitally counting the half-waves of the carrier in the current pulses that are switched on and off, and synchronizing said counting with the frequency of the carrier by using a flywheel circuit.

5. A method for transmitting signals to first and second kinds of rail vehicles and in which there is a first base station equipped with a coder, the base station being connected to a first section of track on which said first and second kinds of vehicles may run, each of the first kind of vehicle having a decoder that operates by pulse frequency demodulation only and is responsive to signals of a pulse frequency modulated carrier in which the pulse duration can be of any value within a given range of percentage of the period of the frequency of the pulses, and in which there is a second section of track on which said rail vehicles may run, there being a second base section with a coder connected to said second section of track, characterized by:

(a) transmitting signals from said first base station to said first section of track by an alternating current carrier that is both frequency modulated and pulse width modulated, with the frequency of modulation being the same as that to which the decoder of said first kind of rail vehicle is responsive and with the pulse width modulation being within said given range of percentage of the period of the pulse frequency, (b) equipping each of said second kind of rail vehicle with a decoder that operates on said signals from said first base station by both pulse frequency demodulation and pulse width demodulation.

(c) transmitting signals from said second base section to said second section of track by an alternating current carrier which is pulse frequency modulated, with the frequency of modulation being the same as that to which the decoder of said first kind of rail vehicle is responsive and with the duration of each pulse being within said given percentage of the period of the frequency of the pulses, (d) transmitting an auxiliary signal to said first section of track but not to said second section of track, (e) inhibiting the decoder of said second kind of rail vehicle from making a pulse width demodulation of the signals from the base section connected to the section of track on which said second kind of rail vehicle is running unless said auxiliary signal is received by said second kind of rail vehicle.

6. A method as set forth in claim 5, further characterized by transmitting the signals from said first mentioned base station to said first mentioned section of track as current pulses of varying duration, each containing several half-waves of said carrier, in alternation with current pauses, that are also of varying lengths, the time widths of the current pulses and of the current pauses being integral and preferably even-number multiples of the alternating current barrier half-wave time, and electronically switching the current pulses on and off at zero-crossings of the alternating current carrier.

7. A method as set forth in claim 6, further characterized by electronically decoding said signals transmitted to said first mentioned section of track at a second rail vehicle and, after said signals are decoded, producing an output signal only after a sequence of equal pulse length signals have been decoded.

8. A method as set forth in claim 7, further characterized in that the decoding at said second rail vehicle is done by digitally counting the half-waves of the carrier in the current pulses that are switched on and off, and synchronizing said counting with the frequency of the carrier by using a flywheel circuit.

* * * * *